US005295691A

United States Patent [19]

Mitsui

[11] Patent Number: 5,295,691

[45] Date of Patent: Mar. 22, 1994

[54] PIECE SHIFT TYPE GAME BOARD BLOCK

[76] Inventor: Itsuko Mitsui, Syanpuren Haitsu 2-2, 27-3, 5-chome, Minaminaruse, Machida-shi, Tokyo, Japan

[21] Appl. No.: 29,868

[22] Filed: Mar. 11, 1993

[51] Int. Cl.[5] ..... A63F 3/00

[52] U.S. Cl. ..... 273/283; 273/287; 446/104; 446/125

[58] Field of Search ..... 273/283, 284, 287, 292; 446/104, 124, 125

[56] References Cited

U.S. PATENT DOCUMENTS

| | | | |
|---|---|---|---|
| 2,434,495 | 1/1948 | Holton | 273/287 |
| 4,142,728 | 3/1979 | Balduman | 273/283 |
| 4,569,527 | 2/1986 | Rosenwinkel et al. | 273/283 |

*Primary Examiner*—Benjamin H. Layno

*Attorney, Agent, or Firm*—Joseph C. Mason, Jr.; Ronald E. Smith; Sinshiro Arichika

[57] ABSTRACT

A generally rectangular game board block has a recessed arcuate part formed in a first end, and a protruding arcuate part formed in a second end. The arcuate parts share a common radius of curvature. In one embodiment, the complemental arcuate parts of contiguous game board blocks abut one another so that they are pivotal with respect to one another. In another embodiment, a retainer associated with the recessed arcuate part engages a rim of the protruding part of a contiguous game block so that the contiguous parts are positively held together as they are rotated with respect to one another. Another embodiment has a hinge-like interconnection and a bias member introduces play into the structure.

3 Claims, 4 Drawing Sheets

PIECE SHIFT TYPE GAME BOARD BLOCK

BACKGROUND OF THE INVENTION

1. Field of the Invention

This invention relates to a piece shift type game board block. More specifically, it relates to a piece shift type game board block capable of adjusting its size by connecting a plurality of game boards by the number to be adapted to the number of players.

2. Description of the Prior Art

An example of conventional piece shift type game boards has been disclosed in Japanese utility model patent application Laid Open No. 73183 1991

FIG. 8 shows a piece shift type game board 800, where numerals 12 to 21 depict concaved holes which are used as steps for advancing playing ball pieces during the game.

In the conventional piece shift type game board 800, the number of the concaved holes can not be changed, so that there has been a problem that the different game boards must be prepared separately for few number of players (few number of concaved holes) and for a large number of players (a large number of concaved holes).

The game board for a larger number of players becomes large scale, therefore it is inconvenient for players to carry on.

SUMMARY OF THE INVENTION

An object of the present invention is to provide a piece shift type game board block capable of adjusting its size to adapt to the number of players.

A first aspect of the invention provides a piece shift type game board block characterized in that a first portion of the main body of the game board, which is provided with a plurality of concaved holes, is provided with an arcuate retainer for retaining the main body to another main body as an angle therebetween is changeable. The arcuate retainer is in closely spaced, parallel relation to a recessed arcuate portion formed in said first end. The retainer and the recessed arcuate portion share a common radius of curvature.

A second aspect of the invention provides a piece shift type game board block characterized in that a second portion of the main body of the game board, which is provided with a plurality of concaved holes, is provided with a protruding, hollow, arcuate contact portion for connecting the main body with another main body as a angle therebetween is changeable. The radius of curvature of the protruding contact portion is the same as the radius of curvature of the retainer and recessed portion formed at the opposite end of the main body. Since the protruding portion is hollow, it includes a rim having the same radius of curvature as that of the retainer and the recessed arcuate portion.

When contiguous main bodies are to be interconnected, the rim of the protruding portion of the first main body is inserted between the retainer and the recessed arcuate portion of a contiguous main body. Since the rim and the respective recessed arcuate portion and the protruding arcuate portion share a common radius of curvature, the contiguous main bodies are thereby pivotally mounted with respect to one another. Moreover, elongate chains, parallelograms, rings, or other geometric configurations may be formed by linking together multiple main bodies. Thus, the number of main bodies in use can always be made equal to the number of players.

The first embodiment of the novel game board block may be summarized as including a main body having a first end and a second end, an arcuate recess formed in said first end, an arcuate retainer formed integrally with said first end, said arcuate retainer being disposed in closely spaced relation to said arcuate recess, an arcuate protrusion formed in said second end, said arcuate protrusion being hollow and having an arcuate rim, and said arcuate recess, said arcuate retainer, and said arcuate rim sharing a common radius of curvature and being disposed in concentric relation to one another, whereby positioning a rim of a first main body in a space between said arcuate recess and said retainer of a contiguous main body serves to pivotally interlock said contiguous main bodies, whereby any number of main bodies may be pivotally interlocked to one another in any predetermined geometrical configuration, and whereby the number of main bodies interlocked to one another may be made equal to the number of players in a game.

In a second embodiment, the novel game board block includes a main body having a first and a second end, a pin-receiving retainer mounted to said first end, a ball-retaining member for retaining a plurality of balls, a pin mounted to and extending radially outwardly from said ball-retaining member, said pin for pivotally engaging said pin-retaining member when contiguous main bodies are pivotally interconnected to one another, and a bias means disposed in interconnecting relation between said second end of said main body and said ball-retaining member, whereby said bias means introduces play into an assembly of pivotally interconnected main bodies, and whereby the number of main bodies pivotally interconnected to one another may be made equal to the number of players in a game.

In a third embodiment, the main bodies are not structurally interconnected as in the first two embodiments but are instead positioned adjacent one another. In such embodiment, the novel game board block includes a main body having a first end and a second end, an arcuate recess formed in said first end, an arcuate protrusion formed in said second end, said arcuate recess and said arcuate protrusion sharing a common radius of curvature and being disposed in concentric relation to one another, whereby positioning a protrusion of a first main body in abutting relation to said arcuate recess of a contiguous main body serves to pivotally align said contiguous main bodies, whereby any number of main bodies may be pivotally aligned with one another in any predetermined geometrical configuration, and whereby the number of main bodies pivotally aligned with one another may be made equal to the number of players in a game.

DETAILED DESCRIPTION OF THE PREFERRED EMBODIMENT

The invention will now be described in detail with reference to embodiments referring to the attached drawings. It is understood that the invention is not limited to the embodiments.

First Embodiment

Figure 1:
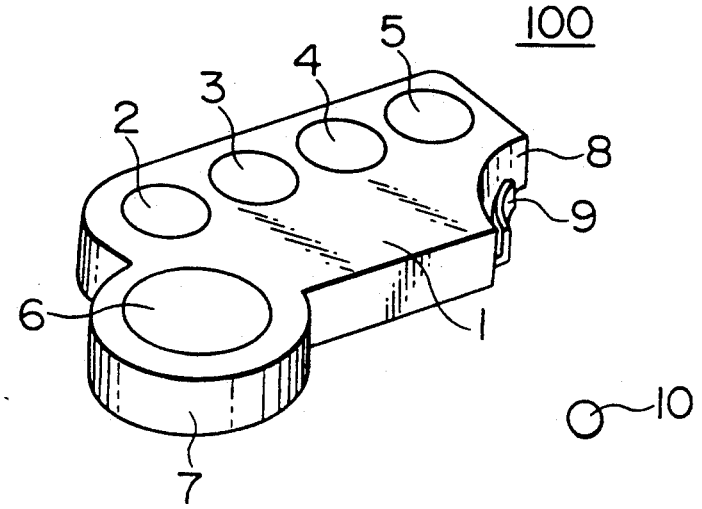
FIG. 1 is a perspective view of an embodiment of a piece shift type game board block according to the invention.

FIG. 1 is a perspective view showing a piece shift type game board block of a first embodiment according to the invention.

In a piece shift type game board block 100 in FIG. 1, numeral 1 depicts a main body, 2 to 5 concaved holes, and 6 a concaved hole for stocking the ball pieces. Numeral 7 depicts a hollow, protruding circular arc section and when the main body connects with another main body, the connection is done by hooking the rim of section 7 to a retainer 9 of a recessed circular arc shape cut portion 8, as best understood in connection with FIGS. 4*a* and 4*b*. Numeral 10 depicts a ball piece.

Figure 2:
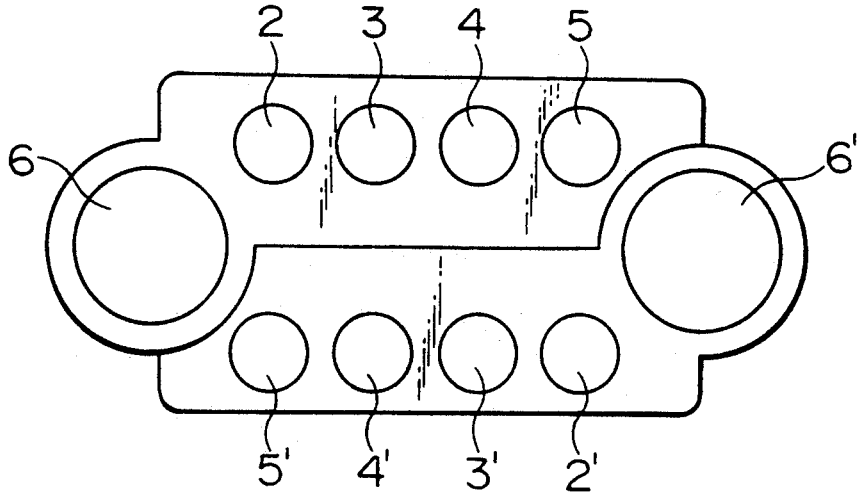
FIG. 2 is a top view showing the state in which two main bodies are combined.

FIG. 2 is a top view showing the state in which two main bodies 1 are combined with each other.

This is the arrangement for a few number of players (few number of concaved holes), where the connection is done by making the rim of the protruding circular arc section 7 fit with the recessed circular arc shaped cut portion 8 by the retainer 9.

Advancing method of the ball piece 10 in this case will be explained.

Now assume that a this-side camp domain is the concaved holes 2 to 5, a mated-side camp domain is the concaved holes 5' to 2', and the concaved holes 6 and 6' on the both ends of them are used for stocking the ball pieces. Then, 40 ball pieces are put into the respective concaved holes by five ball pieces for every one concaved hole.

At first, the first move and the second move are decided.

For example, the first mover selects one of the concaved holes 2, 3, 4, and 5, for example, takes out all the five ball pieces 10 in hand, from the concaved hole 4, if a direction of playing is previously defined counterclockwise, the first mover puts every ball piece sequentially into the concaved holes 5, 6', 2', 3' and 4'.

Next, the second mover in turn of the first mover, in the same manner as described above, for example, takes out all the five ball pieces 10 by hand from the concaved hole 5' and proceeds to put every ball piece sequentially into the concaved holes 6, 2, 3, 4, and 5.

In this way, the first and second players alternately proceed to play the game, and the ball pieces 10 are gradually accumulated in the stock concaved holes 6 and 6'.

Finally, a player who earlier exhausted the ball pieces 10 therefrom is judged as a winner.

As a regulation, in case the ball pieces 10 in hand are just exhausted at the concaved hole 6 or 6', during playing, such player can continue playing one more time as a privilege.

Figure 3:
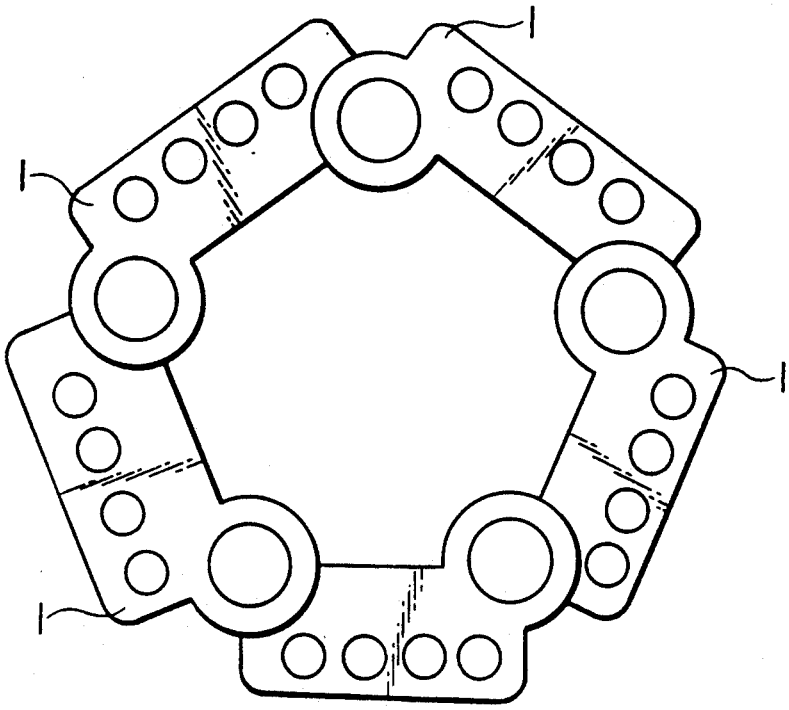
FIG. 3 is a top view showing the state in which five main bodies are combined in a ring shape.

FIG. 3 is a top view showing the state in which the five main bodies 1 are combined in a ring shape.

This is the arrangement for a large number of players (a large number of concaved holes), where respective adjacent couples of the circular arc sections 7 and the circular arc shape cut portions 8 are combined by the retainers 9 in a ring shape.

A method of advancing the ball pieces 10 is the same as in the case of the two game boards combined with each other.

Portions where the main bodies 1 are connected with each other may be of a polygon shape, but in consideration of a freedom of connection, the circular arc shape is most suitable as described above.

For playing the game, any number of the concaved holes are available; however, too many concaved holes require excessive time before the game ends, and too small number of concaved holes result in a rapid termination of the game. For this reason, the most suitable number of the concaved holes is 4.

Figure 4A:
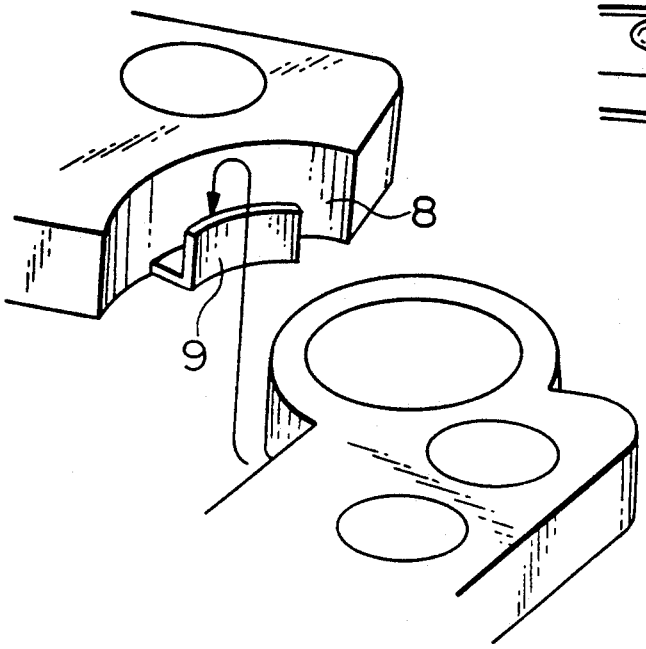
FIG. 4*a* is an illustrative view showing a method when the main bodies are connected.
Figure 4B:
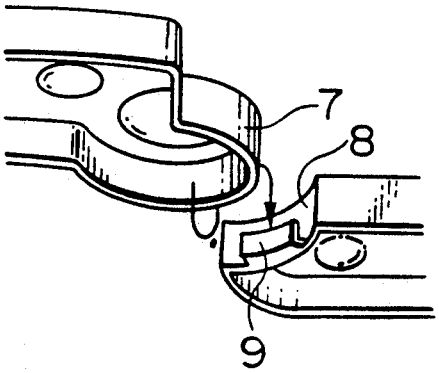
FIG. 4*b* is another illustrative view showing a method of connecting the same.

FIG. 4*a* is an illustrative view showing a method of connection of the main bodies with each other, and FIG. 4*b* is another illustrative view showing a method of connection of the same. Note that parts 7, 8, and 9 have a common radius of curvature.

The retainer 9 is engaged on the rim of the circular arc section 7 so it is rotationally hooked thereto.

Second Embodiment

Figure 5:
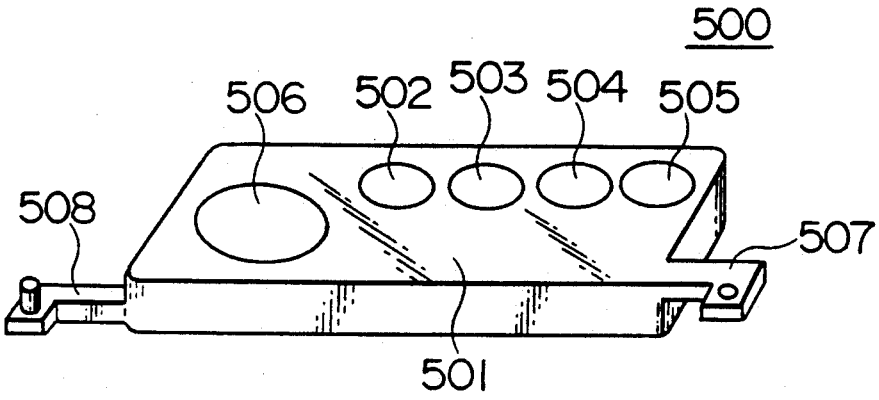
FIG. 5 is a perspective view of a piece shift type game board block of a second embodiment according to the invention.

FIG. 5 is a perspective view showing a piece shift type game board block of a second embodiment according to the invention.

In a piece shift type game board block 500 in FIG. 5, numeral 501 depicts a main body, 502 to 505 concaved holes, and 506 a concaved hole for stocking the ball pieces. Numerals 507 and 508 depict retainers provided on one of longer edges of the main body 501.

The retainer 508 of the main body 501 is connected with the retainer 507 of a contiguous main body 501. A plurality of main bodies 501 may be connected in a ring shape.

Third Embodiment

Figure 6:
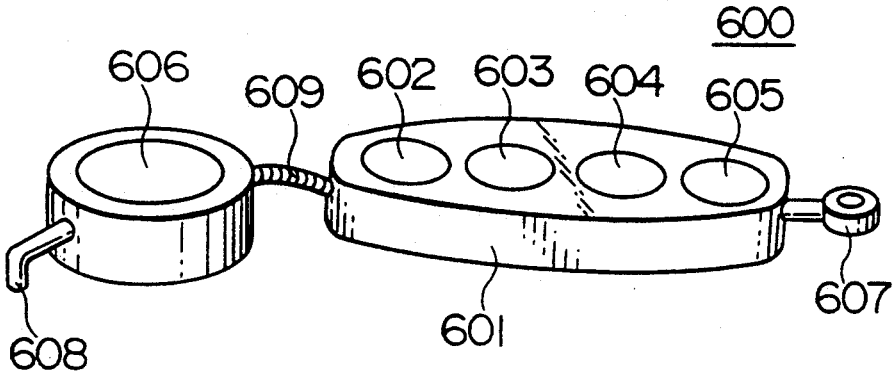
FIG. 6 is a perspective view of a piece shift type game board block of a third embodiment according to the invention.

FIG. 6 is a perspective view showing a piece shift type game board block of a third embodiment according to the invention.

In a piece shift type game board block 600 in FIG. 6, numeral 601 depicts a main body, 602 to 605 concaved holes, and 606 a concaved hole for stocking the ball pieces. Numeral 607 and 608 depict retainers provided on both ends in a longitudinal direction with respect to the main body 601. 609 depicts a connecting coil spring.

The retainer 608 of the main body 601 is connected with the retainer 607 of a contiguous main body 601. A plurality of main bodies 601 may be connected in a ring shape.

Since the connecting coil spring 609 is provided, a degree of freedom on connection increases.

Fourth Embodiment

Figure 7:
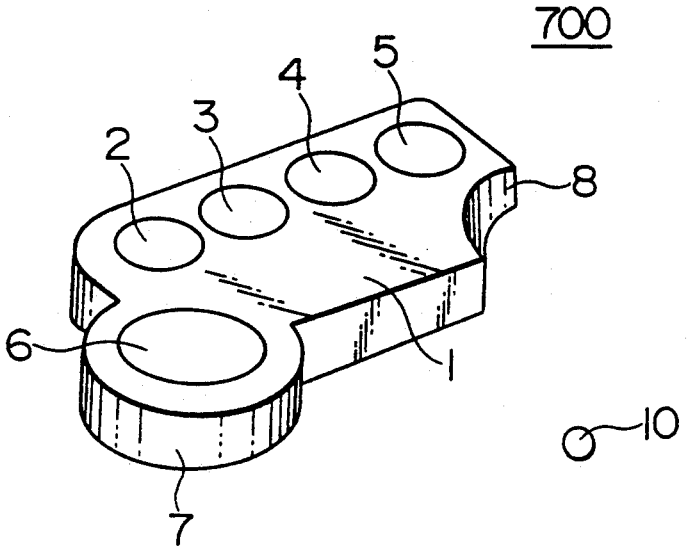
FIG. 7 is a perspective view of a piece shift type game board block of a fourth embodiment according to the invention.
Figure 8:
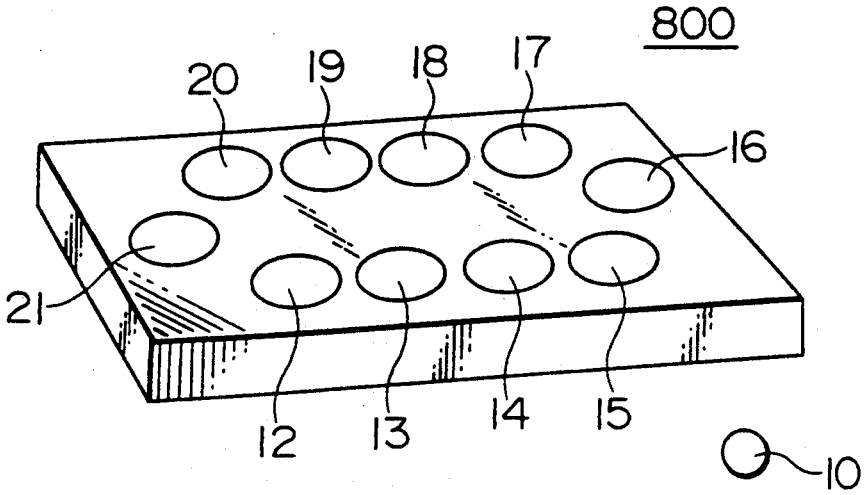
FIG. 8 is a perspective view of the conventional piece shift type game board block.

FIG. 7 is a perspective view showing a piece shift type game board block of a fourth embodiment according to the invention.

In a piece shift type game board block 700 in FIG. 7, numeral 1 depicts a main body, 2 to 5 concaved holes, and 6 a concaved hole for stocking the ball pieces. Numeral 7 depicts a protruding circular arc section. When it connects with a contiguous main body, the protruding circular arc section 7 of said contiguous main body contacts the recessed circular arc cut portion 8 of the contiguous main body. 10 depicts a ball piece.

The state in which the two main bodies 1 are combined with each other is shown in FIG. 2 which is the same in the first embodiment, and the state in which the five main bodies are combined is shown in FIG. 3.

By using the piece shift type game board block according to the invention, sizes of the game board may be changed corresponding to the number of players.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. A game board block, comprising:

a main body having a first end and a second end;

an arcuate recess formed in said first end;

an arcuate retainer formed integrally with said first end, said arcuate retainer being disposed in closely spaced relation to said arcuate recess;

an arcuate protrusion formed in said second end;

said arcuate protrusion being hollow and having an arcuate rim; and said arcuate recess, said arcuate retainer, and said arcuate rim sharing a common radius of curvature and being disposed in concentric relation to one another;

whereby positioning a rim of a first main body in a space between said arcuate recess and said retainer of a contiguous main body serves to pivotally interlock said contiguous main bodies;

whereby any number of main bodies may be pivotally interlocked to one anther in any predetermined geometrical configuration; and whereby the number of main bodies interlocked to one another may be made equal to the number of players in a game.

2. A game board block, comprising:

a main body having a first and a second end;

a pin-receiving retainer mounted to said first end;

a ball-retaining member for retaining a plurality of balls;

a pin mounted to and extending radially outwardly from said ball-retaining member, said pin for pivotally engaging said pin-retaining member when contiguous main bodies are pivotally interconnected to one another; and a bias means disposed in interconnecting relation between said second end of said main body and said ball-retaining member;

whereby said bias means introduces play into an assembly of pivotally interconnected main bodies; and whereby the number of main bodies pivotally interconnected to one another may be made equal to the number of players in a game.

3. A game board block, comprising:

a main body having a first end and a second end;

an arcuate recess formed in said first end;

an arcuate protrusion formed in said second end;

said arcuate recess and said arcuate protrusion sharing a common radius of curvature and being disposed in concentric relation to one another;

whereby positioning a protrusion of a first main body in abutting relation to said arcuate recess of a contiguous main body serves to pivotally align said contiguous main bodies;

whereby any number of main bodies may be pivotally aligned with one another in any predetermined geometrical configuration; and whereby the number of main bodies pivotally aligned with one another may be made equal to the number of players in a game.

* * * * *